US005421070A

United States Patent [19]

Lenk

[11] Patent Number: 5,421,070

[45] Date of Patent: Jun. 6, 1995

[54] GODET FOR GUIDING AND HEATING AN ADVANCING YARN

[75] Inventor: Erich Lenk, Remscheid, Germany

[73] Assignee: Barmag AG, Remscheid, Germany

[21] Appl. No.: 161,758

[22] Filed: Dec. 3, 1993

[30] Foreign Application Priority Data

Dec. 3, 1992 [DE] Germany ..... 42 40 632.3
Sep. 10, 1993 [DE] Germany ..... 43 30 685.3

[51] Int. Cl.[6] ..... D02J 1/22; H05B 6/64

[52] U.S. Cl. ..... 28/240; 219/211; 219/652; 219/674; 492/46

[58] Field of Search ..... 28/240, 241, 242, 243, 28/244, 245, 246; 219/10.61 R, 10.61 A, 469, 470; 492/46

[56] References Cited

U.S. PATENT DOCUMENTS 3,211,893 10/1965 Barlow et al. ..... 28/240
3,412,229 11/1968 Seagrave, Jr. .
3,420,983 1/1969 McCard et al. ..... 28/240
3,479,689 11/1969 Kurzke et al. ..... 28/240
3,508,024 4/1970 Cannon .
3,581,060 5/1971 Bauer .
3,583,687 6/1971 Nakashara ..... 28/240
4,891,872 1/1990 Sussman .

*Primary Examiner*—Clifford D. Crowder
*Assistant Examiner*—Larry D. Worrell, Jr.
*Attorney, Agent, or Firm*—Bell, Seltzer, Park & Gibson

[57] ABSTRACT

A godet for guiding and heating an advancing yarn, which includes a shaft mounted for rotation about its axis, and a casing coaxially and releasably mounted to the shaft. An induction coil heating system is fixedly mounted between the shaft and the outer wall of the casing, and the heating system includes a tubular core having a plurality of induction coils mounted thereon. A plurality of annular ribs are positioned on the core and on the inside of the outer wall of the casing for providing an advantageous magnetic flux path between a core and casing.

21 Claims, 2 Drawing Sheets

GODET FOR GUIDING AND HEATING AN ADVANCING YARN

BACKGROUND OF THE INVENTION

The present invention relates to a heated godet of the type commonly used in the textile industry to process polymeric yarns.

Heated godets having a conical, in particular stepped or terraced shape of the yarn-bearing surface, are known from U.S. Pat. No. 4,891,872. In the known godet, the steps or terraces are individually heated, in that a carrier with a number of heating elements corresponding to the number of terraces is inserted into the interior of the godet from the side having the larger diameter. The heating elements comprise a series of concentric rings arranged one following the other or each engaging into the other over a partial length. This construction is assembled with considerable expense, and to disassemble the godet, it is necessary to first remove the heating elements, which is a time-consuming operation which can also upset the accuracy of the temperature control.

It is accordingly an object of the present invention to provide a heated godet which avoids the above noted disadvantages and limitations of the prior art godets.

It is a more particular object of the present invention to provide a godet for guiding and heating an advancing yarn which is easy to disassemble and re-assemble, as may be required for periodic maintenance and repair.

SUMMARY OF THE INVENTION

The above and other objects and advantages are achieved in accordance with the present invention by the provision of a godet which comprises a support member, and a shaft mounted to the support member for rotation about its axis. A heating means is fixedly mounted to the support member which comprises a tubular ferromagnetic core disposed coaxially about the shaft, with the core including a cylindrical wall portion and a plurality of axially spaced apart annular ribs extending radially outwardly from the wall portion. Also, the ribs have ends which terminate at a common radial distance from the axis of the shaft, and induction coil means is mounted upon the cylindrical wall portion of the core.

A casing is provided, which preferably is composed of a ferromagnetic material and includes a tubular outer wall which defines a radially inner surface and a radially outer surface. The casing is fixedly mounted coaxially with respect to the shaft and so as to rotate therewith about the axis, and so that the inner surface of the outer wall overlies the heating means and the outer surface is adapted to be contacted by the yarn to be heated. In addition, the casing includes a plurality of axially spaced apart annular ribs extending radially inwardly from the inner surface, with the inwardly extending ribs being aligned with respective ones of the outwardly extending ribs and having ends which terminate at a common radial distance from the axis of the shaft so as to define a narrow gap between the ends of said outwardly extending ribs and the ends of the inwardly extending ribs.

In the preferred construction, the shaft is mounted to the support member in cantilever fashion and the shaft includes a free end. Also, the casing further includes a radially directed front wall which is generally aligned with the free end of the shaft, and the casing is mounted to the shaft by means which releasably secures the front wall to the free end of the shaft and such that the casing may be axially removed from the shaft.

In the present invention, the magnetic flux goes substantially through the ribs and only to a very small extent through the front wall of the godet. Although the diameters of the induction coils and the ribs of the core may be identical, it has been shown to be useful to make the diameter of the outwardly extending ribs of the core slightly larger than that of the induction coils. Preferably, the outwardly extending ribs of the core and the inwardly extending ribs of the casing have the same thickness and are advantageously arranged such that opposing ribs each abut an imaginary, common circular cylindrical contour surface.

When the width of the ribs of the core and casing differs, they are preferably arranged such that they extend in an aligned radial direction relative to one another. The core, which may also be designed as a lamella assembly, terminates in two end ribs, of which one may abut the machine support member, whereas the other is positioned adjacent the front wall of the godet. More particularly, the inside surface of the front wall of the casing preferably includes an annular recess which receives the outer end rib of the core therein. Also, the outer end rib and the annular recess have a radial gap therebetween which corresponds to the gap between the opposing inner and outer ribs, and there is a larger axial air gap provided between the outer end rib and the adjacent flat base surface of the annular recess. This axial air gap is preferably sufficiently wide so that a contact between front wall and core is prevented. Furthermore, the avoidance of magnetic fluxes in the front wall of the godet allows axial vibrations to be suppressed.

In the preferred embodiment, an induction coil is positioned between each adjacent pair of ribs on the core, and the coils have a cylindrical configuration. This configuration permits the godet casing to be easily removed from the shaft in the axial direction. The godet casing and its front wall may consist of a ferromagnetic material, and be made, for example, in one piece. However, the front wall may also be made separately and inserted, for example, with a press fit or by welding, into a correspondingly prepared opening of the godet casing. A ferromagnetic material enables the magnetic flux to pass from the core to the godet casing. It is also possible to design and construct the front wall of the casing as a circular disk, which comprises two layers, with the inner layer thereof consisting of the ferromagnetic material. The inner layer preferably has approximately a thickness which corresponds to the width of the outer end rib of the core which is adjacent the front wall of the godet. This allows an advantageous, even heating of the outer end region of the yarn-bearing surface of the casing to be achieved.

While the outer surface of the casing of the godet is in one embodiment a substantially conical contour surface, the surface line respectively pertaining to a yarn-bearing surface may however have different forms of a continuous curve, in particular it may be a straight line. In a further embodiment, the godet surface is stepped, for example terraced with a very fine gradation.

The connection between the godet shaft and the front wall of the casing should be designed such that it is unable to loosen as a result of repeated temperature changes. Particularly suitable is a bolt connection which is produced by a coaxial threaded bore positioned in the godet shaft from its free end, and a necked-down bolt inserted therein. The necked-down bolt may be hollow over its entire length, so as to run, for example, measuring and/or control lines from the godet casing through the godet shaft into the machine frame.

BRIEF DESCRIPTION OF THE DRAWINGS

Some of the objects and advantages of the present invention having been stated, others will appear as the description proceeds, and when taken in conjunction with the accompanying drawings, in which.

DETAILED DESCRIPTION OF THE PREFERRED EMBODIMENT

Figure 1:
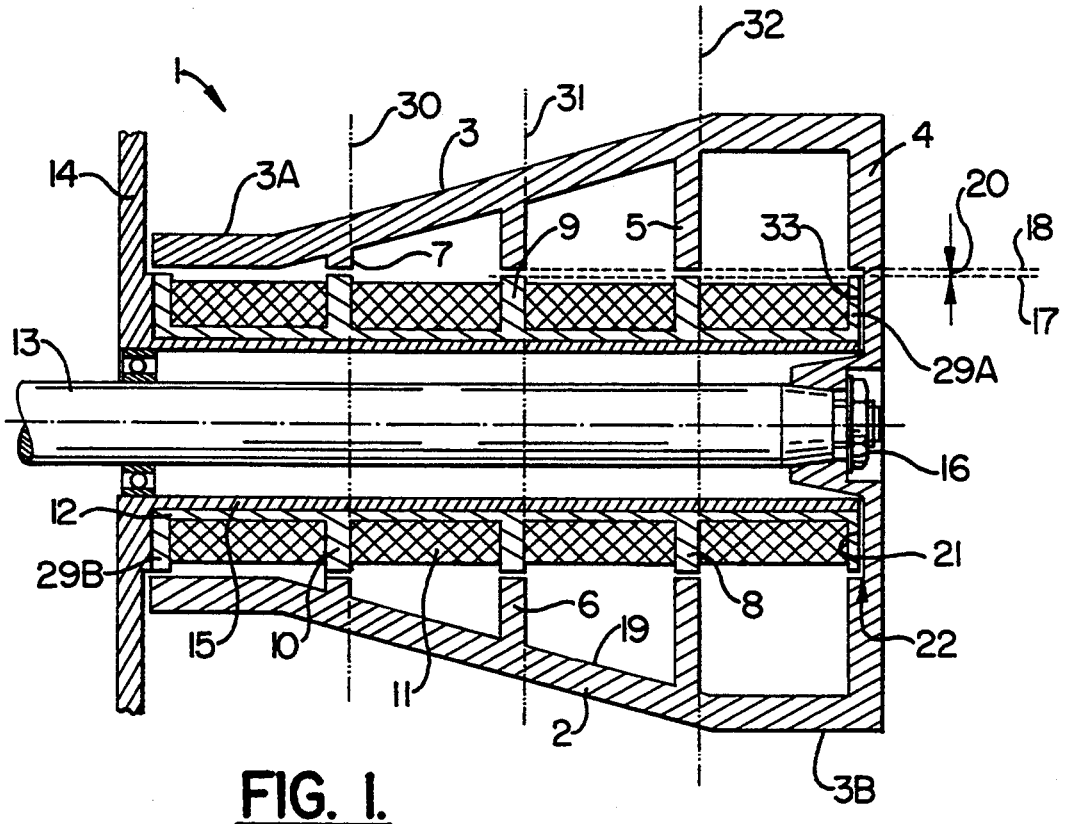
FIG. 1 is a longitudinal sectional view of a godet in accordance with the invention.

Referring more particularly to the drawings, a godet which embodies the present invention is shown in FIG. 1 at 1. The godet 1 comprises a bell-shaped casing 2 which is composed of a tubular outer wall 3 and a front wall 4 which closes the casing 2 at its end having the larger diameter. The front wall 4 is provided with a hub, which has a bore adapted to the tapering free end of a godet shaft 13. By means of a threaded nut 16, the front wall 4 is releasably secured to godet shaft 13, with the front wall 4 extending radially from the axis of the shaft.

The shaft 13 is mounted in cantilever fashion to the support member 14 of the machine frame so as to permit the shaft 13 to rotate about its axis, and the shaft 13 defines a free end to which the front wall 4 of the casing is attached as described above. A cylindrical sleeve 15 is fixed to the support member 14 so as to coaxially surround the shaft An induction heating means is mounted on the sleeve 15. More particularly, the induction heating means includes a tubular ferromagnetic core, which may be in the form of a lamella assembly, and which includes a cylindrical wall portion 12 which is disposed coaxially upon the sleeve 15. The core further includes a plurality of axially spaced apart annular ribs 8, 9, 10 which extend radially outwardly from the wall portion 12. The ribs 8, 9, 10 have ends which terminate at a common radial distance from the axis of the shaft 13, and which terminate on a common imaginary circular cylindrical contour surface 17.

The core also has an outer end rib adjacent the free end of the shaft 13, and an inner end rib 29B adjacent the support member 14. The end ribs 29A, 29B have the same diameter as the ribs 8–10, and they all extend to and terminate on the imaginary cylindrical contour surface 17.

An induction coil 11 is positioned upon the cylindrical wall portion 12 of the core between each adjacent pair of the ribs 8–10, 29A, 29B. All ribs 8–10, 29A and 29B extend radially beyond the outer circumference of induction coils 11. Also, it is possible to have the end rib 29B which abuts the support member 14 to extend with a slight play up to the inside surface of the outer wall of the casing at end 3A.

Arranged in the inside surface of the front wall 4 of the godet which faces inwardly toward the support member 14, is an annular recess 33. The annular recess 33 includes a flat base surface which is parallel to the inside surface of the front wall, and an outer cylindrical surface which is concentric to the axis of the shaft 13 and lies on an imaginary cylindrical boundary surface 18 as hereinafter further described. Also, the end rib 29A of the core is received within the annular recess 33, with a radial play or gap 20 as well as an axial spacing 22, which acts to impede the magnetic flux in the axial direction. The axial spacing 22 is preferably larger than the radial spacing of the gap 20.

In the embodiment shown in FIG. 1, radially inwardly directed ribs 5–7 also extend from the inner surface 19 of the outer wall 3 of the casing 2. In the longitudinal sectional view of FIG. 1, the ribs 5–7 face intermediate ribs 8–10 extending from the core 12, whereas end rib 29A is received into the aforesaid annular recess 33 of the front wall 4 and has there its path for the magnetic flux. As aforesaid, end rib 29B adjacent the support member 14 may extend directly to the inner surface of the outer wall at 3A. The ribs 5–7 proceeding from the inner surface 19 of the outer wall of the casing extend to and terminate on a common imaginary circular cylindrical boundary surface 18. The boundary surface 18 is coaxial with the contour surface 17, and the radius of the boundary surface 18 is larger by the thickness of the magnetic gap 20 provided between the ribs facing one another than the radius of the contour surface 17. Opposite ribs 5–8, 6–9, 7–10 preferably each have the same wall thickness and are radially aligned with one another such that they each abut associated radial planes 30–32 of the godet 1. When the wall thickness of the inner and outer ribs differs, the godet casing 2 is arranged with respect to the ferromagnetic core such that the ribs face one another with their centers aligned.

At each of its ends, the surface of the outer wall 3 of the godet 1 has a cylindrical yarn inlet region 3A and a cylindrical yarn outlet region between which a conical yarn-bearing surface extends. In the illustrated embodiment, the yarn-bearing surface is smooth with a straight line as surface line, however, as is known per se, it may be stepped or have a grip-improving terracing of very fine gradation, if need arises.

Figure 2:
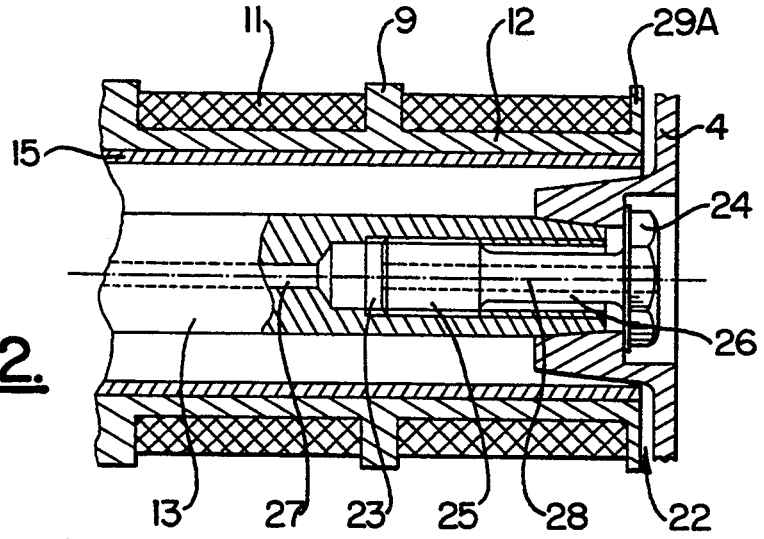
FIG. 2 is a fragmentary longitudinal sectional view of the godet of the present invention and which includes a modified connection between the front wall of the casing and the mounting shaft.

In the embodiment of FIG. 1, the connection of the casing 2 with the godet shaft 13 is provided by a threaded nut 16, which is threaded onto a bolt provided on the free end of godet shaft 13. The nut may be provided with a corresponding locking mechanism (not shown). In some applications, the connection as illustrated in FIG. 1 has turned out to be insecure, and for reasons of safety, the connection as shown in FIG. 2 may be preferred. In this embodiment, a threaded bore 23 extending along the shaft axis is provided in godet shaft 13 from its free end, which receives a necked-down bolt 24 consisting of a threaded portion 25 and a neck 26, preferably by applying a determined torque. Such connections have been found to be lasting and reliable, in particular when used in heated godets. They also have the advantage of a simpler assembly, since during the assembly the godet casing 2 need not be heated to the operating temperatures of godet 1.

Figure 3:
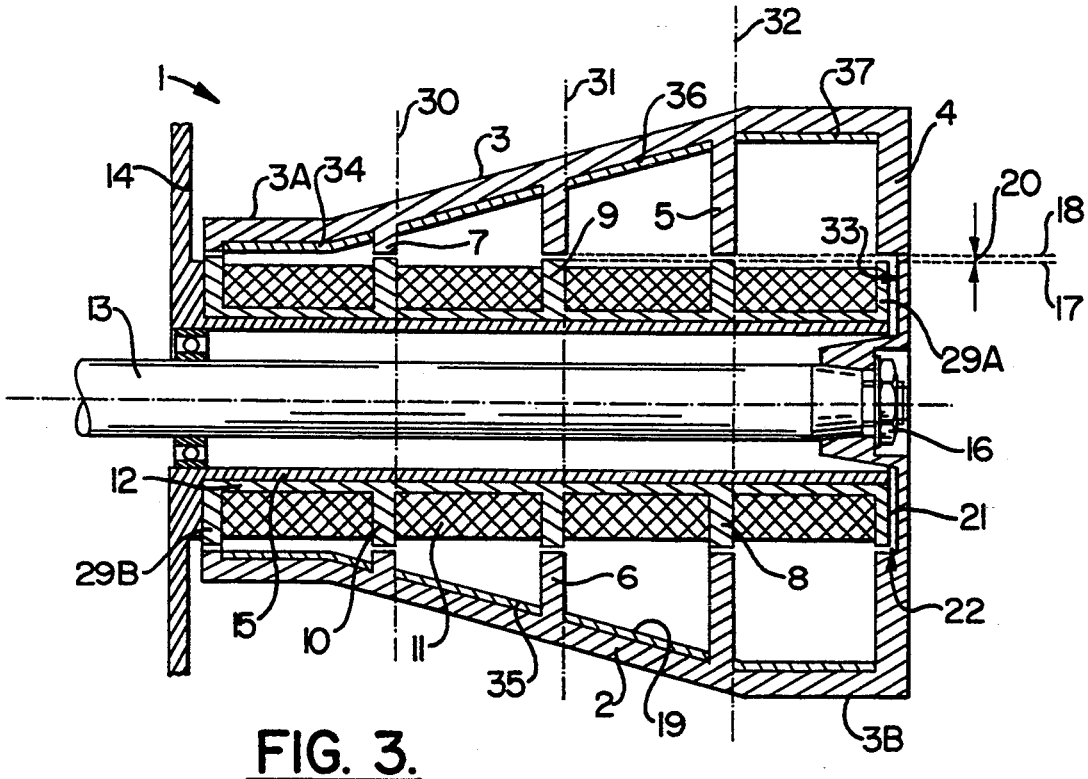
FIG. 3 is a longitudinal sectional view of still another embodiment of the present invention.
Figure 4:
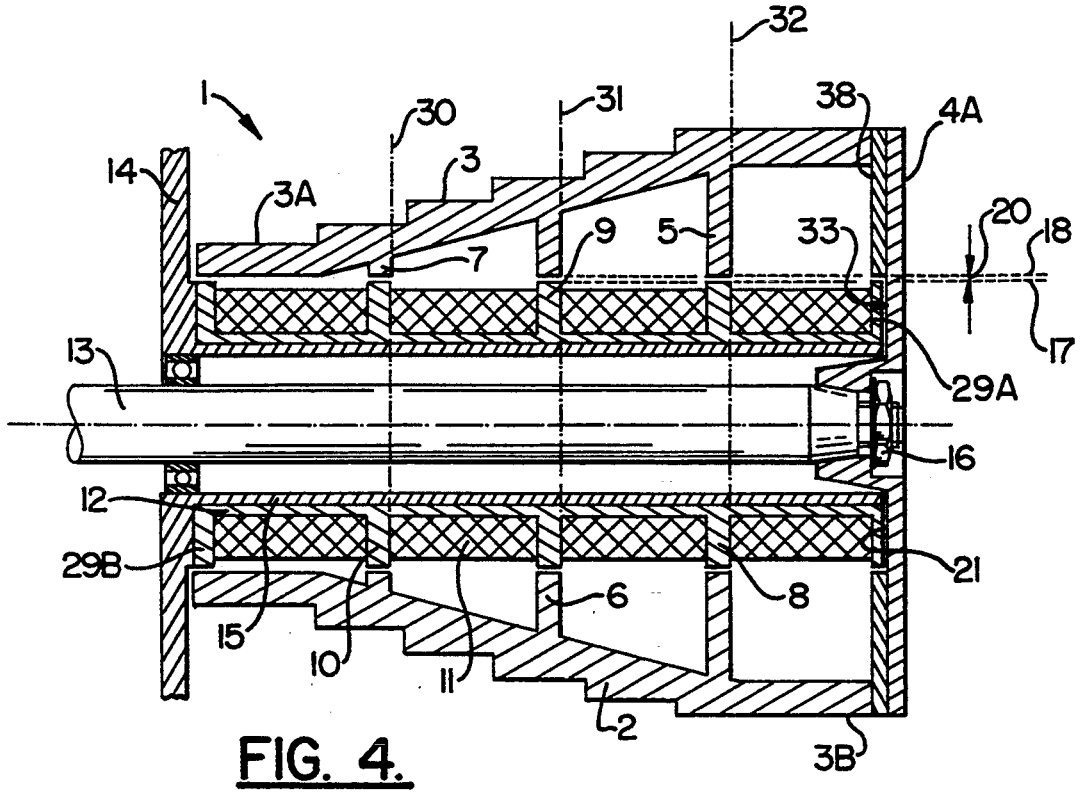
FIG. 4 is a longitudinal sectional view of a further embodiment of the present invention.

To run signal lines which are intended for monitoring the temperature ranges of outer wall 3, it is preferred, as shown in FIG. 2, to provide a signal line conduit 27 along the axis of the godet shaft which continues in the embodiment of FIG. 2 through the necked-down bolt 24. For this reason, the latter is preferably hollow over its entire length and provided with an axial channel As noted above, the casing 2 preferably consists of a ferromagnetic material, and as illustrated in FIGS. 1-3 of the drawings, the outer wall 3 and the front wall 4 are of integral one-piece construction. However, as illustrated in FIG. 4, the front wall may be a separate piece 4A which is joined to the outer wall 3, and the front wall may comprise two layers, with the inner layer 38 consisting of a ferromagnetic material and having substantially the same thickness as the outer end rib 29A.

Shown in FIG. 3 is an embodiment of the godet I which is slightly modified from that of FIG. 1. Like numerals are used to the extent that the structural elements are comparable. In particular, the godet i of FIG. 3 is provided substantially over the entire inner surface of the outer wall 3, namely in all regions between radial outer ribs 5-7 and 29A-B, with radial short-circuit rings 34-37 of an electrically highly conductive metal, such as for example copper, brass or the like. These rings effect an even heating of godet casing 2 to the intended temperature. The short-circuit rings 34-37 on the inner surface of the outer wall 3 may be made, for example, by a suitable centrifugal casting method.

The embodiment of the godet as shown in FIG. 3 further shows at the end of cylindrical region 3A of godet casing 2 the presence of a short radial rib which has an end lying on the imaginary surface 18. Also, in the region of the front wall 4 at the godet end with the larger diameter, there is provided a substantially enlarged axial gap 22 between the axial front end surface 21 of the radial rib 29A of the core and the base surface of the annular recess 33 in the front wall 4 of the godet. This enlarged axial gap 22 is preferred, so as to impede the magnetic flux into the front wall of the godet and corresponding energy losses as a result of axial heat radiation.

Finally, it should be noted that it is possible to further modify the godet within the scope of the present invention. In particular, it is possible to terrace or step the outer yarn-bearing wall 3 in more or less fine increments, as is known per se from U.S. Pat. No. 4,891,872, and as illustrated in FIG. 4. Likewise, the free end of godet 1 may be closed by a cover (not shown) attached to the front wall 4 of the godet, so as to avoid having yarn residues adhere to the threaded connection (i.e., the thread, nut 16, head 24 of necked-down bolt 26), or that the operating personnel are endangered.

In the drawings and specifications, there has been set forth a preferred embodiment of the invention, and although specific terms are employed, they are used in generic and descriptive sense only and not for purpose of limitation.

That which is claimed is:

1. A godet for guiding and heating an advancing yarn and comprising a support member, a shaft mounted to said support member for rotation about the axis of said shaft, heating means fixedly mounted to said support member and comprising a tubular ferromagnetic core disposed coaxially about said shaft, with said core including a cylindrical wall portion and a plurality of axially spaced apart annular ribs extending radially outwardly from said wall portion and having ends which terminate at a common radial distance from said axis, and induction coil means mounted upon said cylindrical wall portion of said core, a casing which includes a tubular outer wall which defines an inner surface and an outer surface, means fixedly mounting said casing coaxially to said shaft so as to rotate therewith about said axis, and so that said inner surface of said outer wall overlies said heating means and said outer surface is adapted to be contacted by the yarn to be heated, said casing further including a plurality of axially spaced apart annular ribs extending radially inwardly from said inner surface, with said inwardly extending ribs being aligned with respective ones of said outwardly extending ribs and having ends which terminate at a common radial distance from said axis so as to define a narrow gap between the ends of said outwardly extending ribs and the ends of said inwardly extending ribs.

2. The godet as defined in claim 1 wherein said shaft is mounted to said support member in cantilever fashion and includes a free end, and wherein said casing further includes a radially directed front wall which is generally aligned with said free end of said shaft, and wherein said mounting means includes means releasably securing said front wall to said free end of said shaft and such that said casing may be axially removed from said shaft.

3. The godet as defined in claim 2 wherein said front wall of said casing includes an inside surface facing said heating means and an annular recess formed in said inner surface, with said annular recess including a flat base surface which is parallel to said inside surface and a cylindrical surface which lies at a radial distance from said axis which substantially corresponds to said common radial distance of said ends of said inwardly extending ribs, and wherein said outwardly extending ribs of said core include an outer end rib which is received within said annular recess.

4. The godet as defined in claim 3 wherein said outer end rib of said core is axially spaced from said base surface of said annular recess a distance greater than the radial gap between said outer end rib of said core and said cylindrical surface of said annular recess.

5. The godet as defined in claim 2 wherein said support member includes a fixedly mounted cylindrical sleeve coaxially overlying said shaft, with said core of said heating means being mounted coaxially upon said sleeve.

6. The godet as defined in claim 2 further comprising a ring of electrically conductive metal mounted so as to overlie said inner surface of said outer wall of said casing between each adjacent pair of said inwardly directed ribs.

7. The godet as defined in claim 2 wherein said casing comprises a ferromagnetic material.

8. The godet as defined in claim 7 wherein said outer wall and said front wall of said casing are of integral one-piece construction.

9. The godet as defined in claim 7 wherein said outer wall of said casing includes a first cylindrical portion at the end thereof opposite said free end of said shaft, and a second cylindrical portion at the end thereof adjacent said free end of said shaft, and with the diameter of said second cylindrical portion being greater than that of said first cylindrical portion.

10. The godet as defined in claim 9 wherein said casing further includes a conical portion positioned between said first and second cylindrical portions.

11. The godet as defined in claim 9 wherein said casing further includes a plurality of stepped cylindrical portions positioned between said first and second cylindrical portions.

12. The godet as defined in claim 9 wherein said inner surface of said casing at said first cylindrical portion lies at a radial distance from said axis which substantially corresponds to said common radial distance of said ends of said inwardly extending ribs.

13. The godet as defined in claim 12 wherein said ribs of said core include an inner end rib which is positioned opposite said inner surface of said casing at said first cylindrical portion thereof.

14. The godet as defined in claim 7 wherein said ends of said outwardly extending annular ribs terminate on a common circular cylindrical contour surface, and said ends of said inwardly extending annular ribs terminate on a common circular cylindrical boundary surface which is coaxial with, and radially spaced from, said contour surface.

15. The godet as defined in claim 2 wherein said mounting means includes an axially directed threaded bore extending into said free end of said shaft, an opening extending through said front wall of said casing in axial alignment with said threaded bore, and a bolt extending through said opening and threadedly engaging said bore.

16. The godet as defined in claim 14 wherein said bolt has a necked down portion intermediate the ends thereof.

17. The godet as defined in claim 3 wherein said front wall comprises a circular disk which is fixed to said outer wall, and wherein said front wall consists of two layers, with the inner layer thereof having a thickness which corresponds to the thickness of said outer end rib.

18. A godet for guiding and heating an advancing yarn and comprising a support member, a shaft mounted in cantilever fashion to said support member for rotation about its axis, and so that said shaft defines a free end, heating means fixedly mounted to said support member and comprising a tubular ferromagnetic core disposed coaxially about said shaft, with said core including a cylindrical wall portion and a plurality of axially spaced apart annular ribs extending radially outwardly from said wall portion and having ends which terminate at a common radial distance from said axis, and an induction coil mounted upon said cylindrical wall portion of said core between each adjacent pair of said ribs, a ferromagnetic casing which includes a tubular outer wall which defines an inner surface and an outer surface, and a radially directed front wall which is generally aligned with said free end of said shaft, means fixedly mounting said casing coaxially to said shaft so as to rotate therewith about said axis, and so that said inner surface of said outer wall overlies said heating means and said outer surface is adapted to be contacted by the yarn to be heated, said mounting means including means releasably securing said front wall of said casing to said free end of said shaft and such that said casing may be axially removed from said shaft, said casing further including a plurality of axially spaced apart annular ribs extending radially inwardly from said inner surface, with said inwardly extending ribs being aligned with respective ones of said outwardly extending ribs and having ends which terminate at a common radial distance from said axis so as to define a narrow gap between the ends of said outwardly extending ribs and the ends of said inwardly extending ribs.

19. The godet as defined in claim 18 wherein said outer wall of said casing includes a first cylindrical portion at the end thereof opposite said free end of said shaft, and a second cylindrical portion at the end thereof adjacent said free end of said shaft, and with the diameter of said second cylindrical portion being greater than that of said first cylindrical portion.

20. The godet as defined in claim 19 wherein said front wall of said casing includes an inside surface facing said heating means and an annular recess formed in said inner surface, with said annular recess including a flat base surface which is parallel to said inside surface and a cylindrical surface which lies at a radial distance from said axis which substantially corresponds to said common radial distance of said ends of said inwardly extending ribs, and wherein said ribs of said core include an outer end rib which is received within said annular recess.

21. The godet as defined in claim 20 wherein said inner surface of said casing at said first cylindrical portion lies at a radial distance from said axis which substantially corresponds to said common radial distance of said ends of said inwardly extending ribs, and wherein said ribs of said core include an inner end rib which is positioned opposite said inner surface of said casing at said first cylindrical portion thereof.

* * * * *